United States Patent [19]

Suzuki

[11] Patent Number: 4,915,681

[45] Date of Patent: Apr. 10, 1990

[54] CENTRIFUGAL SEPARATOR WITH CONTINUOUS DISCHARGE

[75] Inventor: Tomio Suzuki, Tokyo, Japan

[73] Assignee: Nishihara Environmental Sanitation Research Corporation, Tokyo, Japan

[21] Appl. No.: 316,793

[22] Filed: Feb. 28, 1989

[30] Foreign Application Priority Data

Feb. 29, 1988 [JP] Japan ..... 63-44424

[51] Int. Cl.[4] ..... B04B 1/20

[52] U.S. Cl. ..... 494/54

[58] Field of Search ..... 494/52, 53, 54, 55, 494/56, 57, 58; 210/781, 782

[56] References Cited

U.S. PATENT DOCUMENTS 4,378,906 4/1983 Epper ..... 494/53

FOREIGN PATENT DOCUMENTS 46-5648 2/1971 Japan .
47-9993 3/1972 Japan .
52-16268 5/1977 Japan .
54-44276 4/1979 Japan .
57-29222 6/1982 Japan .
57-36269 8/1982 Japan .
61-27645 8/1986 Japan .
456353 11/1936 United Kingdom ..... 494/54

*Primary Examiner*—Robert W. Jenkins
*Attorney, Agent, or Firm*—Helfgott & Karas

[57] ABSTRACT

A centrifugal separator with continuous discharge comprises a rotating bowl having a slurry inlet orifice, a sludge discharge port and a liquid discharge port arranged therein; a screw positioned concentrically inside the rotating bowl and rotating in the same direction as but at a different speed from the rotating bowl; and at least one baffle plate is provided within the pitch of the screw extending in the radial direction, so that it is immersed in the liquid separated and accumulated in the rotating bowl in the main section in which the solid/liquid separation is carried out.

15 Claims, 2 Drawing Sheets

PRIOR ART

CENTRIFUGAL SEPARATOR WITH CONTINUOUS DISCHARGE

BACKGROUND OF THE INVENTION

1. Field of the Invention

The present invention relates to a centrifugal separator with continuous discharge, specifically to a centrifugal separator wherein a slurry is continuously separated into a sludge and a liquid, and the separated sludge and liquid are continuously discharged.

2. Description of the Related Art

Conventionally, a centrifugal separator, such as the countercurrent or counterflow type of centrifugal separator shown in FIG. 1, comprises a rotating bowl 1, a screw shaft 2 positioned concentrically within the interior of the bowl 1, and a screw 3 mounted, for example, by being welded, in a spiral manner on the outer circumference of the screw shaft 2 so that flights 3*a* of the screw 3 are spaced from each other by a pitch 7.

The rotating bowl 1 and the screw 3 rotate in the same direction. However, the rotating bowl 1 and the screw 3 rotate at different speeds. For this reason, a slurry fed into the rotating bowl 1 is separated into a sludge and a liquid as a result of the centrifugal force in the rotating bowl 1, and the sludge is precipitated onto a inner peripheral surface 1*a* of the rotating bowl 1, transferred to a left side section 1*b* by the screw 3 as shown in FIG. 1, during which the sludge is concentrated. Then the sludge is discharged to the outside from a sludge discharge port 5 at one end of the rotating bowl 1, while the separated liquid flows through a flow channel between the screw flights and overflows from a liquid discharge port 4 at the other end of the rotating bowl 1, that is, on the right side of FIG. 1, and is discharged to the exterior of the centrifugal separator.

In addition to the countercurrent flow system shown in FIG. 1, other types of centrifugal separators variously contrived are used, such as the concurrent type. One feature these types of centrifuges have in common is the fact that they are constructed to provide a rotating bowl and a screw for scraping the sludge from the rotating bowl.

The problems to be solved by the present invention will be explained in relation to the helical angle of the screw and the width of the flow channel in centrifugal separators constructed to have such a screw.

In the centrifugal separator shown in FIG. 2, the helical angle $\theta$ of the screw 3 is larger than for the unit shown in FIG. 1. When the helical angle $\theta$ of the screw 3 is made larger as in this centrifugal separator, the width of the flow channel of the screw increases and the length of the flow channel is decreased. Conversely, when the helical angle $\theta$ is made smaller as in FIG. 1, the width of the flow channel of the screw decreases and the length of the flow channel is increased.

When the flow channel is long, the flow rate of the slurry is generally speeded up, so that turbulent flow is produced, resulting in that the efficiency of the sludge precipitation is reduced and, as a result, the cleanliness of the separated liquid deteriorates.

Accordingly, in order to avoid the situation as mentioned above, the centrifugal separator is usually constructed with a large helical angle and a wide but short flow channel. However, when the width of the flow channel is increased, the flow rate is reduced, but swirling flows are produced between the screw flights in the cross sectional direction at right angles to the flow channel, resulting in the problem of poor separation of the sludge. For this reason, to improve the effective separation, there are double screw type centrifuges in which the flow channel is shortened and its width is decreased.

In the double screw type, two flow channels are formed in the rotating bowl, which is opposed to the centrifugal separators having a single flow channel as in FIG. 1 and FIG. 2 and therefore referred to as the single screw type. Specifically, in the single screw type, one flow channel is formed with one screw extending from a slurry inlet orifice 6 to the sludge discharge port 5 or the liquid discharge port 4. In contrast, in the double screw type, a plurality of slurry inlet orifices are divided into an equal number and two flow channels are formed with two screws, extending as far as each of the previously mentioned discharge ports.

In the case of the double screw type, it is theoretically possible to reduce the amount of turbulent flow in the flow channel and the amount of swirling flows in the cross sectional direction. However, in actual fact, the balancing of the feed of the slurry between the two flow channels cannot be performed very well. For example, because of plugging up of the slurry inlet orifice for one of the flow channels, a difference in the amount of sludge produced or conveyed, and other effects which may be encountered, it is difficult to uniformly distribute the slurry in the double screw type. For this reason, it frequently happens that the properties of the sludges and liquids separated from each other inside the two flow channels are not the same.

Since the efficiency of the centrifugal separator is represented by the flow channel having worse properties of the separated sludge or the separated liquid, as previously discussed, the performance of the centrifugal separator is often deemed to be not satisfactory and the centrifugal separation is often deemed to be not stable, so the centrifugal separator is inadequate unless the properties of the sludges and the liquids for the two flow channels are the same.

As outlined above, the difference in screw velocity is made small, and/or the helical angle of the screw is made large, so that turbulent flow lessens, whereby the precipitation effect is being increased and the unit transport capacity of the sludge becomes large. Thus, various means are employed to increase the solids recovery rate and improve the quality of the overflow liquid. However, even when the width of the flow channel is increased and the rate of flow in the direction of flow is reduced, in actual fact, it frequently happens that an improvement in separation performance is not obtained.

This is because other conditions as well as a problem with the Reynolds Number affect the flow state considered in a static system. For example, inside the rotating bowl to which centrifugal force is applied, the motion of the liquid in the flow channel is three dimensional and very complicated. For this reason, the effect of the application of centrifugal force is diminished and turbulent flow is easily produced.

Whichever model of centrifugal separator is used, if the balance between the separated sludge and the separated liquid is not satisfactorily adjusted, the performance is not good. Within the centrifugal separator, in the case of a centrifugal extractor, even if the balance between the sludge and the liquid is not satisfactorily adjusted, the recovery rate of the solid material can be compensated by the addition of a coagulant. However, in the case of a centrifugal concentrator which does not utilize a coagulant, a wide variety of devices must be used in order to discharge a clean liquid after separation, in other words, in order to increase the solid recovery ratio.

SUMMARY OF THE INVENTION

The object of the present invention is to provide, with due consideration to the drawbacks of such conventional devices, a centrifugal separator with a continuous discharge wherein the swirling flow produced within the pitch of the screw in the cross sectional direction in the flow channel is eliminated.

Another object of the present invention is to provide a centrifugal separator with an improvement in performance by forming at least one baffle plate within the pitch of the screw.

These objects are achieved in the present invention by the provision of a centrifugal separator with continuous discharge comprising a rotating bowl having a slurry inlet orifice, a sludge discharge port and a liquid discharge port arranged therein, a screw positioned concentrically within the interior of the rotating bowl and having flights and rotating in the same direction as but at a different speed from the rotating bowl, and at least one baffle plate provided within between the screw flights.

BRIEF DESCRIPTION OF THE DRAWINGS

These and other objects, features, and advantages of the present invention will become more apparent from the following description of the preferred embodiments taken in conjunction with the accompanying drawings, in which.

DETAILED DESCRIPTION OF THE PREFERRED EMBODIMENTS

Figure 1:
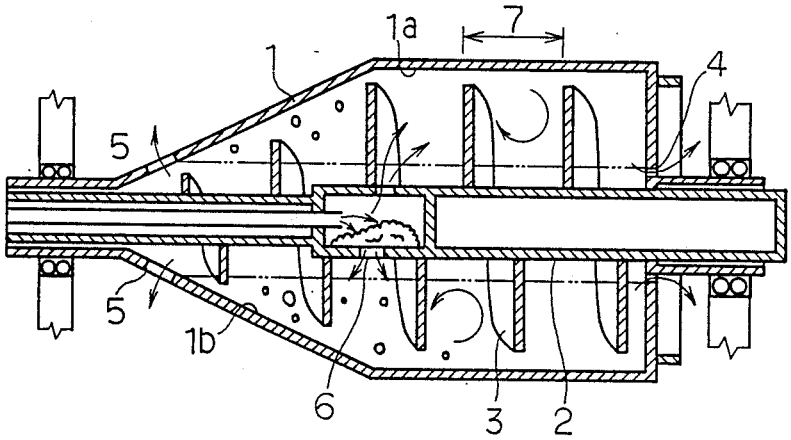
FIG. 1 is a vertical cross-sectional view showing a conventional centrifugal separator.
Figure 2:
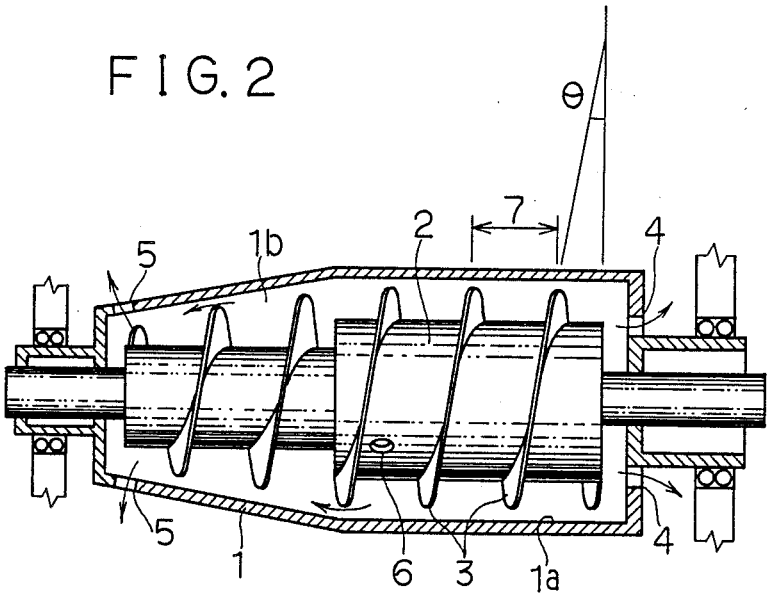
PRIOR ART FIG. 2
FIG. 2 is a vertical cross-sectional view showing another conventional centrifugal separator wherein the helical angle of the screw is explained.
Figure 3:
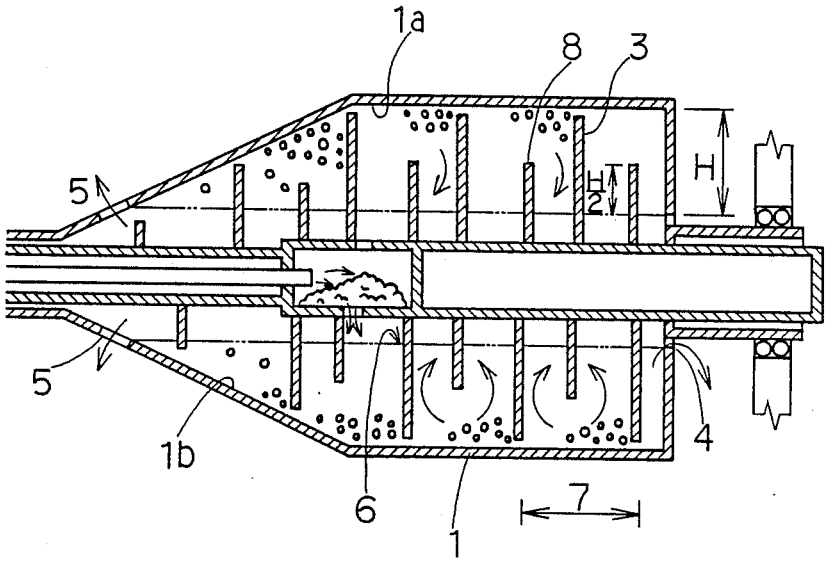
FIG. 3 is a vertical cross-sectional view showing one embodiment of the present invention.

Now referring to the drawings, the centrifugal separator of FIG. 3, comprises a rotating bowl 1 and a screw 3 in the same way as the centrifugal separators shown in FIG. 1 and FIG. 2. The rotating bowl 1 has a slurry inlet orifice 6 in a central portion thereof, a sludge discharge port 5 on the left side thereof and a liquid discharge port 4 on the right side thereof. The screw 3 is positioned concentrically inside the rotating bowl 1 and rotating in the same direction as but at different speeds from the rotating bowl 1.

Then the screw 3 is caused to rotate, the sludge contained in the slurry which is fed from the slurry inlet orifice 6 is subjected to the centrifugal force and precipitated onto the inner peripheral surface 1*a* of the rotating bowl 1, and is concentrated by being transported by means of the screw 3 in the direction of a left side section 1*b* in the drawing and is discharged from the slurry discharge port 5. The separated liquid passes through a flow channel between the flights of the screw 3 and is discharged by overflowing from the liquid discharge port 4 in the rotating bowl 1.

In this case, as previously outlined, if a pitch 7 of the screw 3 is wide, a swirling flow 9 would be produced in the cross sectional direction in the flow channel, specifically between the flights of the screw 3. The swirling flow 9 would stir up the sludge which has been precipitated or is about to be precipitated on the inner peripheral surface 1*a* of the rotating bowl 1, so that it becomes mixed with the separated liquid. Therefore, a high concentration of solids would be contained in the separated liquid, so that the solids recovery ratio is reduced.

In the present invention, a main section of the rotating bowl 1 in which the solid/liquid separation is carried out, for example, in the case of the centrifugal separator of FIG. 3, a section from the slurry inlet orifice 6 to the liquid discharge port 4, at least one baffle plate 8 of the screw type is provided within the pitch 7 of the screw 3. Specifically, at least one baffle plate 8 extending helically in the axial direction in the rotating bowl 1 is inserted between the flights and at the same pitch as the pitch 7 of the screw 3. Therefore, any concern about the swirling flow 9 which would be otherwise produced in the liquid accumulated on the wall of the bowl 1 is eliminated, so that the precipitation effect is increased, and a clear or clean supernatant liquid is separated in the rotating bowl 1 and discharged from the liquid discharge port 4.

It is important that in the longitudinal cross sectional view, the at least one screw-shaped baffle plate 8 radially extends at the center of the pitch 7 of the screw 3 to a point where no swirling flow 9 is produced in the liquid in the cross sectional direction, which is the direction substantially perpendicular to the flow channel. Specifically, the length of the baffle plate 8 in the radial direction must be less than the height of the flights of the screw 3, but the baffle plate 8 must reach as far as to become immersed in the liquid of depth H in the rotating bowl 1. Preferably, the length of the baffle plate 8 in the radial direction should be enough for the tip of the baffle plate 8 to reach a point about ½ of the liquid depth H. As a result, no swirling flow 9 is produced in the cross sectional direction of the flow channel and the precipitated slurry is not stirred up, so that the separated liquid is clear or clean, and the solids recovery ratio is improved.

As previously described, if the baffle plate 8 does not extend to the point where it is immersed in the liquid of depth H in the rotating bowl 1, the production of the swirling flows 9 would not be not prevented. Conversely, if the baffle plate 8 is too long, specifically, if the tip of the baffle plate 8 exceeds the point about ½ of the liquid depth H, it would contact the precipitated sludge, and also cut into the sludge, producing the similar defects as previously described for the double screw type. This must be avoided.

Although only one baffle plate is shown in FIG. 3, a plurality of baffle plates may be provided.

The above-mentioned baffle plate differs from the screw inasmuch as the baffle plate is provided merely to prevent the swirling flow and does not contact the sludge. Accordingly, the material of the baffle plate does not have to be abrasion resistant.

The positions of the slurry inlet orifice 6, sludge discharge port 5, and liquid discharge port 4 may be varied according to the type of centrifugal separator and are not restrictive with respect to this embodiment of the present invention.

In operation, in the centrifugal separator with continuous discharge of the present invention, by the provision of at least one baffle plate within the pitch of the screw in the main section wherein the solid/liquid separation is carried out, specifically, the section from the slurry inlet orifice to the liquid discharge port, swirling flows in the cross sectional direction inside the flow channel are not produced, so that the precipitation effect is improved, and a clear supernatant liquid is separated and discharged.

What is claimed is:

1. A centrifugal separator for separating a liquid from a slurry, with continuous discharge, comprising:

a rotating bowl having a peripheral outer wall defining a space for accumulation of the slurry therein, said bowl rotating about an axis, said bowl having a first shaft hole at one end thereof and a second shaft hole at a second opposite end thereof;

a screw shaft extending along said axis in said bowl and received in said first and second holes and having a slurry inlet orifice which is in communication with said space, said outer wall having a sludge discharge port in the vicinity of said first shaft hole and a liquid discharge port in the vicinity of said second shaft hole;

a screw positioned inside said rotating bowl concentrically therewith and including said screw shaft and a screw vane having a pitch, said screw vane rotating about said axis substantially in the same direction as said bowl but at a different speed from said rotating bowl; and at least one baffle plate radially extending within the pitch of the screw vane in said space, said at least one baffle plate having a tip end positioned radially outward of said liquid discharge port.

2. A centrifugal separator of claim 1, wherein said at least one baffle plate is provided in a main section of the rotating bowl in which the solid/liquid separation is carried out.

3. A centrifugal separator of claim 2, wherein said at least one baffle plate is provided in a section between said slurry inlet orifice and the liquid discharge port.

4. A centrifugal separator of claim 2, wherein the baffle plate is made of a non-abrasion resistant material.

5. A centrifugal separator of claim 1, wherein the baffle plate is smaller in the radial direction than said screw vane, and is at least partly immersed in the liquid in the rotating bowl.

6. A centrifugal separator of claim 5, wherein the baffle plate has a tip which reaches a point about half the depth of the liquid.

7. A centrifugal separator of claim 1, wherein the screw vane has flights continued with each other and said at least one baffle plate is provided between two neighboring flights.

8. A centrifugal separator of claim 7, wherein the baffle plate is smaller in the radial direction than the screw vane, and is at least partly immersed in the liquid in the rotating bowl.

9. A centrifugal separator of claim 8, wherein the baffle plate has a tip which reaches a point about half the depth of the liquid.

10. A centrifugal separator of claim 7, wherein the baffle plate is made of a non-abrasion resistant material.

11. A centrifugal separator of claim 1, wherein the baffle plate is made of a non-abrasion resistant material.

12. A centrifugal separator of claim 1, wherein the tip end of said at least one baffle plate is positioned radially midway between said liquid discharge port and said outer wall at a radially outermost portion thereof.

13. A centrifugal separator of claim 1, wherein said outer wall comprises a conical section, a cylindrical section and an end face section, said conical section having said sludge discharge port, said end face section having said liquid discharge port, and wherein said tip end of said at least one baffle plate is positioned radially midway between said liquid discharge port and the outer wall at said cylindrical section thereof.

14. A method of operating a centrifugal separator for separating a liquid from slurry in a rotating bowl having an outer wall forming a space for accumulation of the slurry therein and rotating about an axis, the outer wall having a first shaft hole provided at one end thereof and a second shaft hole provided at another opposite end thereof, the outer wall having a sludge discharge port provided in the vicinity of the first shaft hole and a liquid discharge port provided in the vicinity of the second shaft hole, a screw positioned concentrically inside said rotating bowl and including a screw shaft extending through the first and second shaft holes and a screw vane having a pitch, the screw vane rotating about said axis substantially in the same direction as said bowl but at a different speed from the rotating bowl, the screw shaft having on one end thereof a slurry inlet orifice which is in communication with said space within the outer wall, and at least one baffle plate radially extending within the pitch of the screw vane in the space, the method comprising the steps of introducing the slurry through the slurry inlet orifice until the slurry is accumulated in the space of the rotating bowl so that said at least one baffle plate is partly immersed in the slurry, whereby a swirling flow is prevented from occurring in the liquid within the pitch of the screw vane in said space when the screw vane and the rotating bowl are rotated.

15. A centrifugal separator for separating a liquid from a slurry with continuous discharge, comprising:

a rotating bowl having a peripheral outer wall defining a space for accumulation of the slurry therein, said bowl rotating about an axis, said bowl having a first shaft hole at one end thereof and a second shaft hole at a second opposite end thereof;

a screw shaft extending along said axis in said bowl and received in said first and second holes, and having a slurry inlet orifice which is in communication with said space, said outer wall having a sludge discharge port in the vicinity of said first shaft hole and a liquid discharge port in the vicinity of said second shaft hole;

a screw positioned inside said rotating bowl concentrically therewith and including said screw shaft and a screw vane having a plurality of flights and rotating about said axis in the same direction with but at a different speed from said bowl; and a plurality of baffle plates each positioned between two adjacent flights within a screw pitch and having tips ends positioned radially at a greater distance from said axis as said liquid discharge port so that said tip ends are immersed in said slurry whereby swirling flows in the liquid within a screw pitch between said flights are prevented from occurrence when the separator is in operation.

* * * * *